US005086196A

United States Patent [19]

Brookbank et al.

[11] Patent Number: 5,086,196

[45] Date of Patent: Feb. 4, 1992

[54] ELECTRO-MECHANICAL CABLE FOR CABLE DEPLOYED PUMPING SYSTEMS

[75] Inventors: Earl B. Brookbank, Bartlesville, Okla.; Walter Dinkins, Lawrence, Kans.

[73] Assignee: Camco, Incorporated, Houston, Tex.

[21] Appl. No.: 564,834

[22] Filed: Aug. 9, 1990

[51] Int. Cl.[5] ..... H01B 7/18

[52] U.S. Cl. ..... 174/106 R; 174/102 R; 174/102 P; 174/108; 174/109

[58] Field of Search ..... 174/106 R, 108, 109, 174/102 R, 102 P

[56] References Cited

U.S. PATENT DOCUMENTS

| | | | |
|---|---|---|---|
| 2,147,096 | 2/1939 | Hochstadter | 173/266 |
| 2,283,117 | 5/1942 | Arutunoff | 174/109 X |
| 2,531,917 | 11/1950 | Mollerhoj et al. | 174/106 R |
| 2,604,509 | 7/1952 | Blanchard | 174/108 |
| 2,980,755 | 4/1961 | Fairfield et al. | 174/24 |
| 3,230,300 | 1/1966 | Rubinstein et al. | 174/108 X |
| 3,485,224 | 12/1969 | Ronald | 174/109 |
| 3,573,349 | 4/1971 | Bowers | 174/108 |
| 3,602,632 | 8/1971 | Ollis | 174/36 |
| 3,679,812 | 7/1972 | Owens | 174/108 |
| 3,717,718 | 2/1973 | Schmidtchen | 174/106 D |
| 3,742,363 | 6/1973 | Carle | 174/102 R |
| 3,773,109 | 11/1973 | Eberline | 174/113 R X |
| 3,790,697 | 2/1974 | Buckingham | 174/109 X |
| 3,800,066 | 3/1974 | Whitfill, Jr. et al. | 174/116 |
| 3,812,283 | 5/1974 | Kothe et al. | 174/105 R |
| 3,889,049 | 6/1975 | Legg et al. | 174/102 R |
| 4,282,398 | 8/1981 | Solomon | 174/106 R |
| 4,408,089 | 10/1983 | Nixon | 174/34 |
| 4,440,974 | 4/1984 | Naudet | 174/108 |
| 4,557,560 | 12/1985 | Bohannon, Jr. et al. | 350/96.23 |
| 4,749,823 | 6/1988 | Ziemek et al. | 174/103 |
| 4,956,523 | 9/1990 | Pawluk | 174/107 |

FOREIGN PATENT DOCUMENTS

| | | |
|---|---|---|
| 1148167 | 12/1957 | France . |
| 15641 | 1/1909 | United Kingdom . |

*Primary Examiner*—Morris H. Nimmo
*Attorney, Agent, or Firm*—Arnold, White & Durkee

[57] ABSTRACT

An electro-mechanical cable for use in cable deployed pumping systems includes a containment layer surrounding a cable core and constructed to restrain outward radial expansion of the core while permitting longitudinal expansion.

14 Claims, 1 Drawing Sheet

ELECTRO-MECHANICAL CABLE FOR CABLE DEPLOYED PUMPING SYSTEMS

BACKGROUND OF THE INVENTION

This invention relates to electro-mechanical cables for cable deployed (cable suspended) pumping systems, and is more particularly concerned with a cable construction that imposes substantial restraint against outward radial expansion of a cable core without imposing substantial axial restraint, and that prevents kinking due to radial expansion.

Over the last two decades there has been substantial progress in perfecting down hole equipment for cable deployed pumping systems. Reliability of the down hole equipment has improved substantially and has been confirmed by extensive testing. Nevertheless, the electro-mechanical cable for deploying the down hole equipment and for providing electrical power has remained a weak link in the system.

Electro-mechanical cables for use in cable deployed pumping systems require special properties that are not found in ordinary electrical cables. For example, a #1 size three-conductor electrical cable can normally support tensile loads of only 2,000 to 4,000 lbs , but a #1 electro-mechanical cable for use in cable deployed pumping systems must be capable of supporting tensile loads in excess of 100,000 lbs.

One of the problems that has plagued electro-mechanical cables for cable deployed pumping systems is kinking of the cable due to thermal expansion. Prior attempts to solve this problem have required complex and expensive cable structures designed so as to physically separate the strength members of the cable from the electrical core.

Another problem is gas embolism due to rapid decompression of the cable after gases have dissolved in elastomeric materials of the cable. Rapid decompression occurs when down hole equipment is pulled from a well by means of the cable. In an effort to solve the embolism problem, the electrical core has been enveloped in a braid consisting of two layers of 132-0.014" dia. galvanized improved plow steel wires inter-woven in 12 bundles of 11 wires each wrapped at a neutral angle (e.g., about 53°) that allows equal axial and radial expansion of the cable core. However, this cable construction has a kinking problem caused by thermal expansion of elastomeric cable insulation and jacket material interacting with steel armor wires that surround the braid. The following analysis underlying the invention is believed to explain this problem.

The cable can be considered to be in a zero stress condition during assembly, at a nominal temperature of 70° F. When the cable is installed in a well whose temperature is substantially higher, the cable temperature will increase to the high well temperature. The elastomers in the core, which have a thermal expansion approximately ten times that of the steel armor wire, will increase in volume. The steel armor wire, due to its lay angle and orientation, will prevent any axial growth of the core, but the elastomers in the core will increase in diameter. The diameter of the armor will increase, but the length of the armor wire will stay constant, causing the length of the cable to decrease. This applies compressive stress to the cable, which buckles the copper conductors, and ultimately causes an electrical failure.

BRIEF DESCRIPTION OF THE INVENTION

The present invention provides a solution to the foregoing problem. More particularly, in accordance with the invention, outward radial expansion of the cable core is restrained while axial expansion is permitted. To achieve this result, the pressure containment braid previously employed is replaced by a pressure containment layer specifically designed to prevent outward radial expansion of the cable core while allowing the cable core to expand longitudinally. In a preferred embodiment, the pressure containment layer is constituted by a strip wound helically upon the cable core at angles that are very low with respect to cross sectional planes of the cable and very high with respect to longitudinal planes.

BRIEF DESCRIPTION OF THE DRAWINGS

The invention will be further described in conjunction with the accompanying drawings, wherein.

DETAILED DESCRIPTION OF PREFERRED EMBODIMENTS

Figure 1:
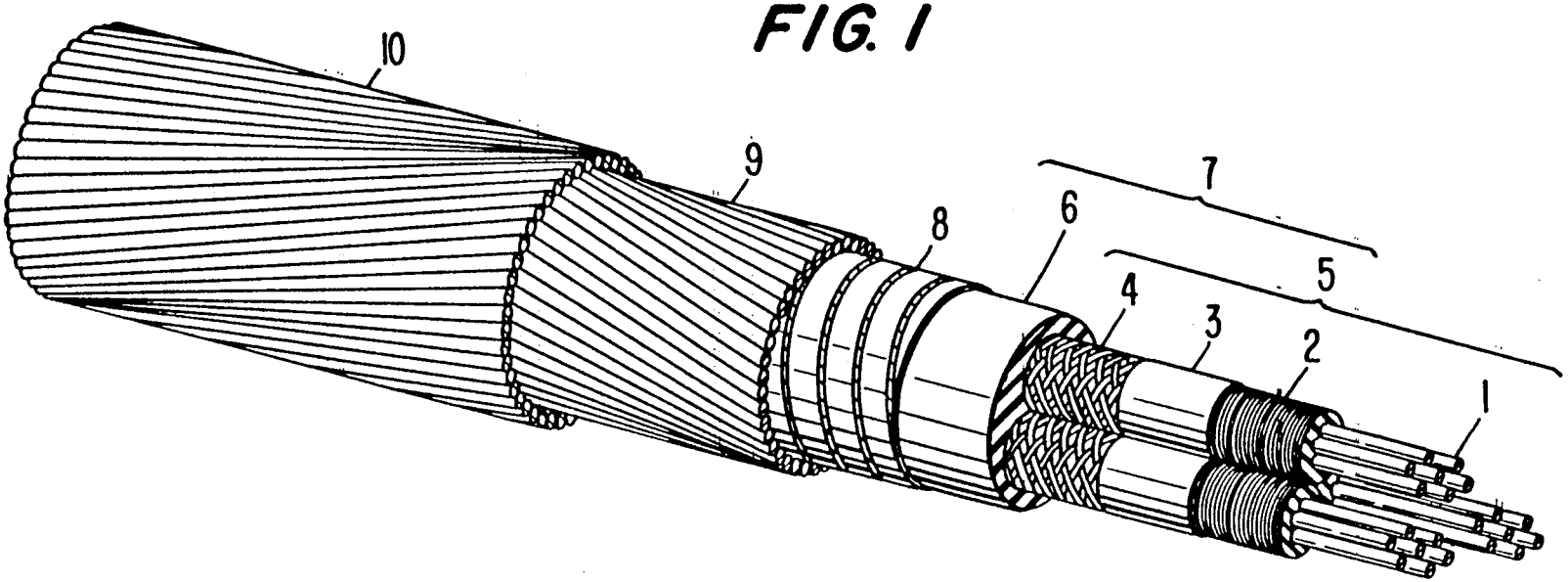
FIG. 1 is a perspective view of a cable construction in accordance with the invention.

Referring to the drawings, reference numerals 1–4 designate components of insulated conductor means 5, and reference numerals 5 and 6 designate components of cable core 7. The insulated conductor means 5 comprises conductors 1, of stranded or solid copper, for example, surrounded integrally by conductor insulation 2 formed of an elastomer such as EPDM (ethylene propylene diene monomer) and constituting the primary electrical insulation on the conductors. Insulation 2 is surrounded by helically wound Teflon tape 3 that protects the conductor insulation from attack by well fluid. Nylon braid 4 is used to hold the tape layer on during manufacturing processing. The tape layer facilitates axial movement of the insulated conductors relative to core jacket 6 to prevent damage to the cable when the cable is bent. The core jacket 6 is formed of an elastomer such as EPDM or nitrile rubber. The tape-wrapped insulated conductors are embedded in the core jacket material so as to protect the insulated conductors from mechanical damage and to join the insulated conductors with the core jacket as a unit.

In accordance with the invention, instead of the braid described earlier for containing the core, a pressure containment layer 8 is employed that is designed to provide a strong restraint against outward radial expansion of the core and yet to permit axial expansion of the core (i.e., axial restraint is weak). By virtue of the construction of the pressure containment layer, outward radial expansion of the cable core is prevented, and the kinking problem is overcome.

Figure 2:
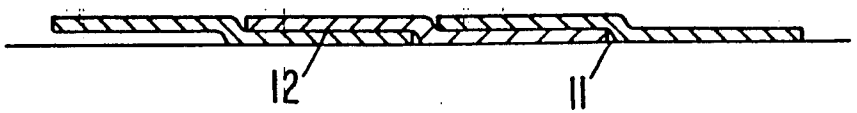
FIG. 2 is a longitudinal sectional view of a pressure containment layer in accordance with the invention.

As shown in FIGS. 1 and 2, the pressure containment layer 8 is formed of an elongate member 12 (preferably stainless steel) wound helically on the surface 11 of the core jacket 6. The helical winding is preferably (although not necessarily) constituted by overlapping strip material, such as a half-lapped strip. Alternatively, the pressure containment layer may be formed of round cross section wire tightly wound nearly perpendicular to the length of the core to provide substantially 100% coverage of the jacket, or may be formed of a redesigned braid in which the braid wires are wrapped on the surface of the core nearly perpendicular to the length of the core. The containment material need not be metal, as long as the tensile strength is sufficient to contain the core pressure. In any case, the pressure containment winding must have a substantial number of turns per unit length of the cable. This is achieved by having the turns form small angles with respect to cross sectional planes of the cable and large angles with respect to longitudinal planes. It is preferred that the angles with respect to longitudinal planes be at least about 70°.

The pressure containment layer 8 is surrounded by one or more armor layers, such as an inner armor layer 9 and an outer armor layer 10. The armor layers may form a conventional contra-helical armor package (in which layer 10 is wound oppositely to layer 9) to provide the required mechanical strength to the cable structure. The number of armor layers may vary from one to four, for example. Each armor layer may be formed of round cross section steel wire or of strip material, for example. Armor wires are wound at high angles with respect to cross sectional cable planes. The winding direction of the pressure containment layer 8 may be opposed to that of the inner armor layer 9 (and also to that of the conductors 1, if helically bundled, so that torque due to tension in the winding of the pressure containment layer is opposed by torque due to tension in the inner armor layer (and also the conductors 1, if helically bundled). Elastomeric bedding material may fill interstices of wire armor.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. An electro-mechanical cable for use in a cable deployed pumping system and the like, comprising a cable core including insulated conductor means extending longitudinally of the cable and a core jacket surrounding the insulated conductor means, a pressure containment layer surrounding the cable core, and armor means surrounding the pressure containment layer, the pressure containment layer having means for restraining outward radial expansion of the cable core while permitting longitudinal expansion, whereby gas embolism and kinking of the cable due to outward radial expansion oft he cable core are alleviated, wherein said insulated conductor means includes a plurality of wires with integral insulation surrounded by tape means for permitting longitudinal movement of the insulated wires relative to the core jacket when the cable is bent, and wherein said core jacket is formed of an elastomer that embeds the insulated conductor means therein to form said cable core as a unit to which the pressure containment layer is applied.

2. An electro-mechanical cable according to claim 1, wherein said restraining means comprises an elongate member forming a helical winding on said core jacket.

3. An electro-mechanical cable according to claim 2, wherein said helical winding is constituted by successive turns forming angles with respect to cross sectional planes of said cable that are substantially smaller than angles formed by said turns with respect to longitudinal planes of said cable,

4. An electro-mechanical cable according to claim 3, wherein the last-mentioned angles are at least about 70°.

5. An electro-mechanical cable according to claim 3, wherein said winding is formed of a flat strip.

6. An electro-mechanical cable according to claim 5, wherein successive turns of said flat strip overlap.

7. An electro-mechanical cable according to claim 3, wherein said armor means comprises at least one armor layer including elongate elements that are helically wrapped about said pressure containment layer, said elements forming angles with respect to cross sectional planes of said cable that are substantially greater than angles formed by said elements with respect to longitudinal planes of said cable.

8. An electro-mechanical cable according to claim 7, wherein the winding direction of said elongate member of said restraining means is opposite to the winding direction of an elongate element of an armor layer that is wound on said containment layer.

9. An electro-mechanical cable for use in a cable deployed pumping system and the like, comprising a cable core including insulated conductor means extending longitudinally of the cable and a core jacket surrounding the insulated conductor means, a pressure containment layer surrounding the cable core, and armor means surrounding the pressure containment layer, the pressure containment layer having means for restraining outward radial expansion of the cable core while permitting longitudinal expansion, whereby gas embolism and kinking of the cable due to outward radial expansion of the cable core are alleviated, wherein said restraining means comprises an elongate member forming a helical winding on said core jacket, said helical winding being constituted by successive turns forming angles with respect to cross sectional planes of said cable that are substantially smaller than angles formed by said turns with respect to longitudinal planes of said cables.

10. An electro-mechanical cable according to claim 9, wherein the last-mentioned angles are at least about 70°.

11. An electro-mechanical cable according to claim 9, wherein said winding is formed of a flat strip.

12. An electro-mechanical cable according to claim 11, wherein successive turns of said flat strip overlap.

13. An electro-mechanical cable according to claim 9, wherein said armor means comprises at least one armor layer including elongate elements that are helically wrapped about said pressure containment layer, said elements forming angles with respect to cross sectional planes of said cable that are substantially greater than angles formed by said elements with respect to longitudinal planes of said cable.

14. An electro-mechanical cable according to claim 13, wherein the winding direction of said elongate member of said restraining means is opposite to the winding direction of an elongate element of an armor layer that is wound on said containment layer.

* * * * *